US006047760A

United States Patent [19]

Judkins

[11] Patent Number: 6,047,760

[45] Date of Patent: Apr. 11, 2000

[54] LIFT SYSTEM FOR HEAVY VENETIAN TYPE BLINDS

[76] Inventor: Ren Judkins, 46 Newgate Rd., Pittsburgh, Pa. 15202

[21] Appl. No.: 09/128,751

[22] Filed: Aug. 4, 1998

[51] Int. Cl.[7] ..... E06B 9/30

[52] U.S. Cl. ..... 160/168.1 R; 160/84.04; 160/173 R

[58] Field of Search ..... 160/168.1 R, 173 R, 160/178.1 R, 84.04, 84.05, 172 R

[56] References Cited

U.S. PATENT DOCUMENTS

| | | | |
|---|---|---|---|
| 2,055,826 | 9/1936 | Nottingham | 160/173 R |
| 2,072,835 | 3/1937 | Dodge | 160/173 R |
| 2,087,629 | 7/1937 | Krause | 160/173 R |
| 2,200,349 | 5/1940 | Walker . | |
| 2,307,278 | 1/1943 | Krantz . | |
| 2,421,505 | 6/1947 | Hunter | 160/173 R |
| 2,482,036 | 9/1949 | Stutz | 160/173 R |
| 2,616,496 | 11/1952 | Junkunc | 160/173 R |
| 2,783,831 | 3/1957 | Moyer | 160/173 R |
| 3,327,765 | 6/1967 | Strahm et al. | 160/168.1 R |
| 3,460,601 | 8/1969 | Abraham . | |
| 5,655,590 | 8/1997 | Bryant | 160/168.1 R |

FOREIGN PATENT DOCUMENTS

| | | | |
|---|---|---|---|
| 528777 | 3/1958 | Italy | 160/168.1 R |
| 1165243 | 9/1969 | United Kingdom | 160/168.1 R |

*Primary Examiner*—Blair M. Johnson
*Attorney, Agent, or Firm*—Buchanan Ingersoll, P.C.

[57] ABSTRACT

In a cording arrangement for large blinds having several lift cords one end of at least some of the lift cords is attached to the headrail and then the lift cord is routed into the bottomrail, over a pulley in the bottomrail, back up to the headrail and through a cord lock forming a generally U-shaped cording arrangement. The cords are attached to the headrail and routed through the headrail in such a manner that the cords are of equal or nearly equal length. Preferably the outermost cords are descending. The cords are laced around or through the rungs of the ladder. Preferably each descending cord has more passes through the rungs than each ascending cord.

44 Claims, 5 Drawing Sheets

LIFT SYSTEM FOR HEAVY VENETIAN TYPE BLINDS

FIELD OF THE INVENTION

The invention relates to a lift system for heavy venetian blinds and specifically a cording arrangement for lift cords used in such blinds.

BACKGROUND OF THE INVENTION

Venetian type blinds are well-known window coverings. They typically consist of a headrail and a bottomrail and slats resting on ladders strung between the headrail and bottomrail. The bottomrail is raised and lowered by lift cords which run from the bottomrail through route holes in the slats and into the headrail. A cord lock is usually provided at one end of the headrail and the lift cords are routed through the cord lock. The blind is raised and lowered by pulling or releasing the lift cords. In another type of blind disclosed in my U.S. Pat. No. 5,573,051, the lift cords are routed through slots on the front edge or back edge of the slats. There are no route holes in the slats.

Venetian blinds are typically made from plastic or aluminum extrusions. In recent years wood blinds have become more popular. In wood blinds the slats are wood strips, wood composites or plastic formed to look like wood and the bottomrail and headrail may either be assembled from pieces of wood, wood laminated over a metal or plastic frame, or in the case of the bottomrail, a solid piece.

With the advent of double pane and other thermally insulated windows, builders are installing larger and larger windows in buildings. Most home windows do not exceed three feet in width. However, some homes have wider picture windows and multiple pane windows which together extend beyond three feet. Homeowners usually want to cover these windows with a single blind. There are also commercial buildings where the width of the window may be up to six feet or larger and the height equally as large. Some building owners desire to have a single venetian blind cover each of those large windows. Therefore, manufacturers now offer venetian blinds which are in excess of three feet in width. These large blinds can be quite heavy weighing over 20 pounds. About forty pounds of lift is required to raise a fully lowered 20 pound blind. The solution to lifting these blinds has been to provide additional lift cords, perhaps as many as one lift cord every eight to twelve inches along the width of the blind so that the weight is distributed over several cords. Because these blinds are so large, the lift cords are much longer than are found in blinds having a width of three feet or less. The lift cords are made from a braided material and will stretch. Consequently, I have noticed that in larger blinds the stretch will be unequal causing one end or the middle of the blind to sag or bow upward as the blinds are raised and lowered.

Another phenomenon which I have observed in very large blinds that I have recently made is that the descending cords move faster than the ascending cords. That is, if the cord is routed from an attachment point in the headrail to the bottomrail, though the bottomrail, back up into the headrail and out through the cord lock, the portion of the cord between the headrail and bottomrail and which goes to the cord lock would be descending and will move faster than that portion of the cord between the headrail and the bottomrail and which is attached to the headrail called the ascending portion. This occurs because the ascending portion tends to stretch more than the descending portion. Such stretching causes the bottom of the blind to bow as the blind is raised and lowered.

Consequently, there is a need for a lift system and particularly a cording arrangement which provides controlled lowering and raising of a heavy venetian blind without distortion.

SUMMARY OF THE INVENTION

I provide a cording arrangement for heavy blinds having several lift cords and in which one end of at least some of the lift cords is attached to the headrail and then the lift cord is routed into the bottomrail and back up to the headrail and through a cord lock forming a generally U-shaped cording arrangement. I further provide that the cords be attached at one end to the headrail and routed through the headrail in such a manner that the cords are nearly of equal length. That is the length of each cord from the end attached to the headrail to the point where the cord passes through the cord lock is not more or less than the length of each other cord plus or minus the distance between two adjacent vertical cord runs. I also arrange the cords so that the outermost cords are descending.

To overcome the problem of descending cords moving faster than ascending cords, I weave the cords through or around the rungs of the adjacent ladder. They are woven in manner so that each descending cord has more passes through the rungs than the ascending cord.

Other objects and advantages of the invention will become apparent from a description of certain preferred embodiments shown in the figures.

DESCRIPTION OF THE PREFERRED EMBODIMENTS

Figure 1:
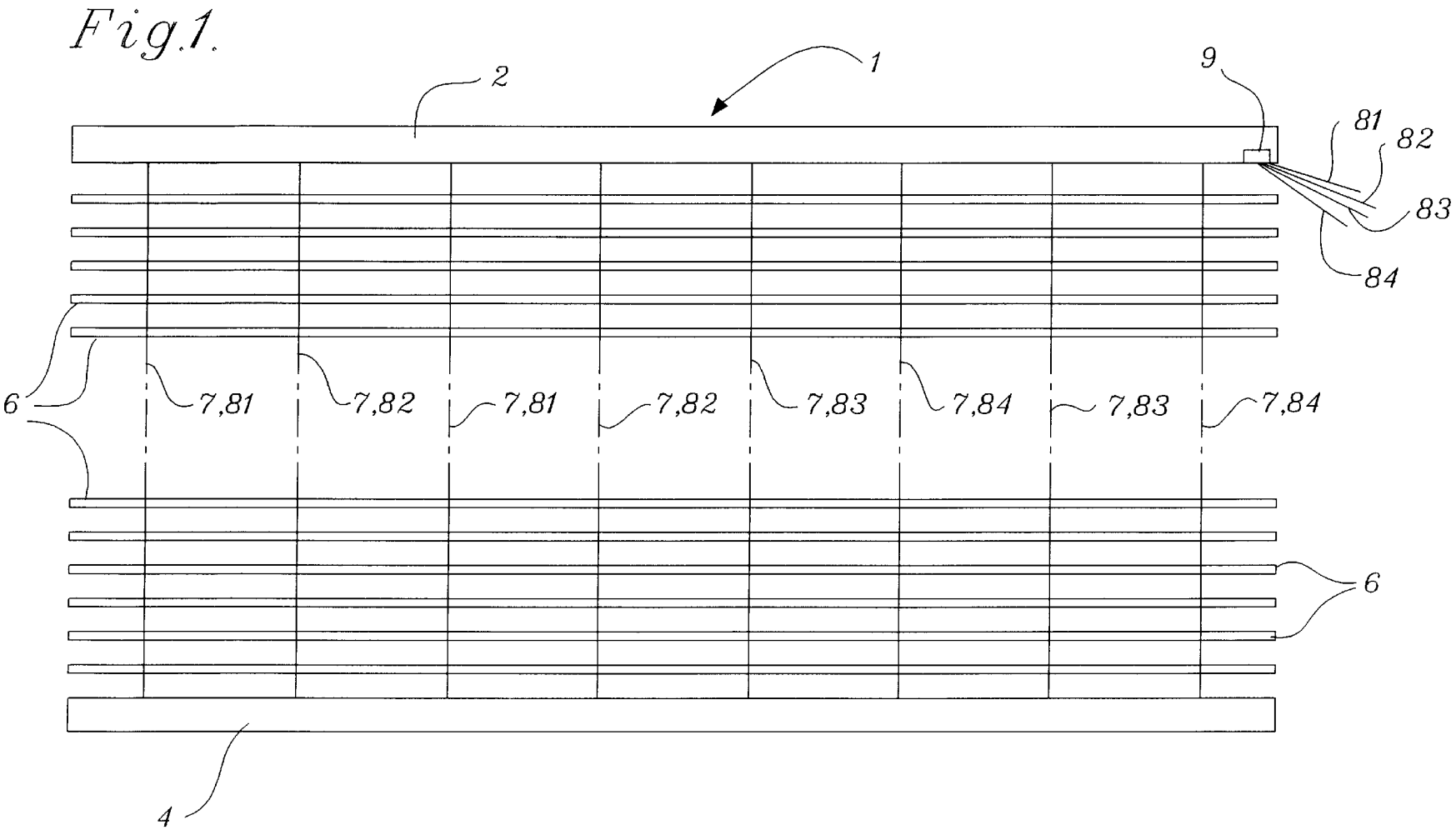
FIG. 1 is a front view of a large venetian blind containing my preferred lift system.
Figure 2:
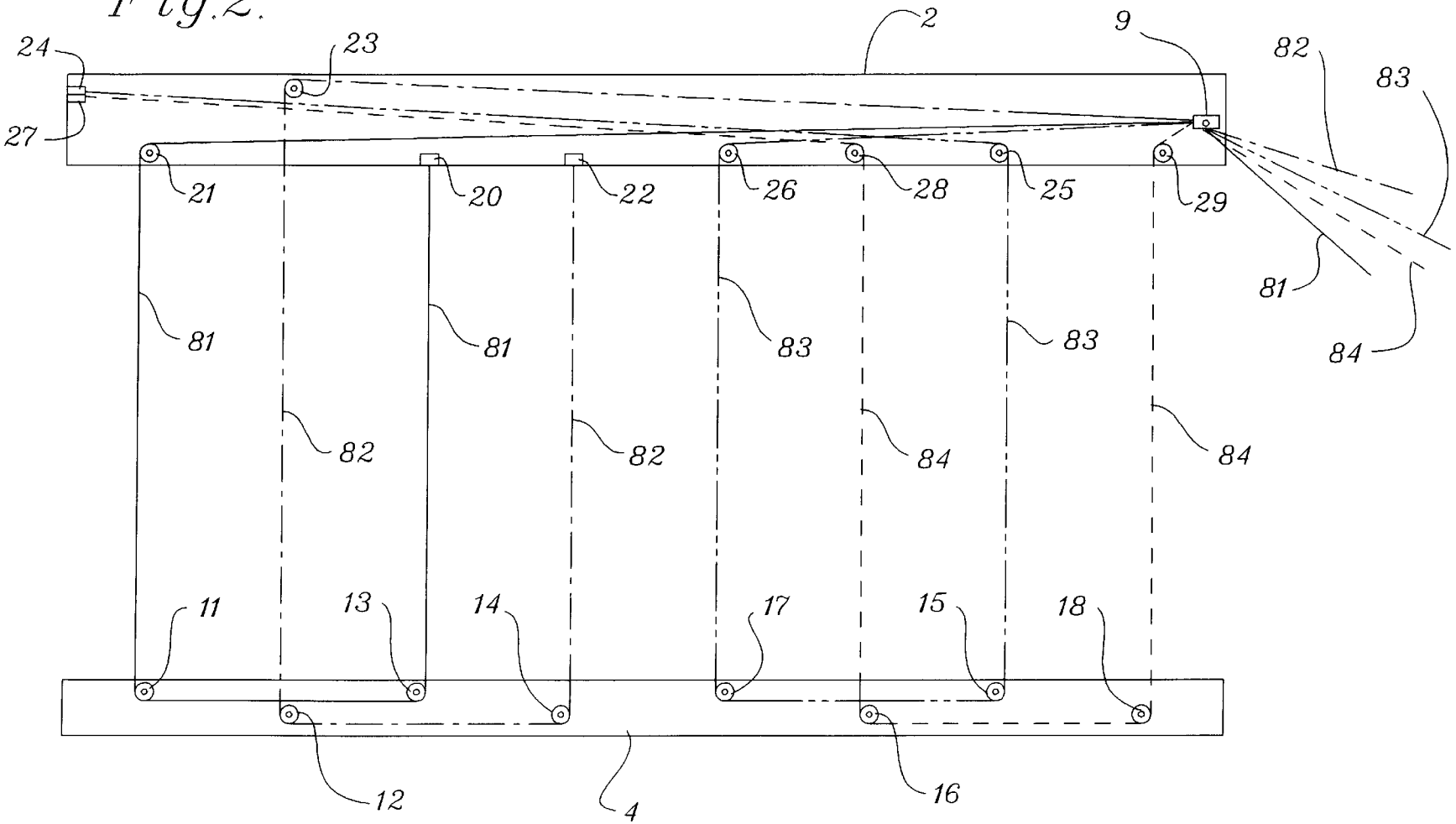
FIG. 2 is a diagram showing the cording arrangement for the blind of FIG. 1.

Referring to FIGS. 1 and 2, I provide a venetian blind 1 having a headrail 2 and bottomrail 4 with a series of ladders 7 extending from the headrail to the bottomrail. A series of slats 6 are carried on the rungs (not shown) of the ladders. Lift cords 81, 82, 83, 84 run from the headrail through the bottomrail and back to the headrail exiting through cord lock 9. To distinguish the lift cords in FIG. 2, a distinctive line pattern was used for each cord. The lift cords run adjacent the ladders passing through route holes in the slats or across the front edge or rear edge of the slats near the ladder rails.

Figure 8:
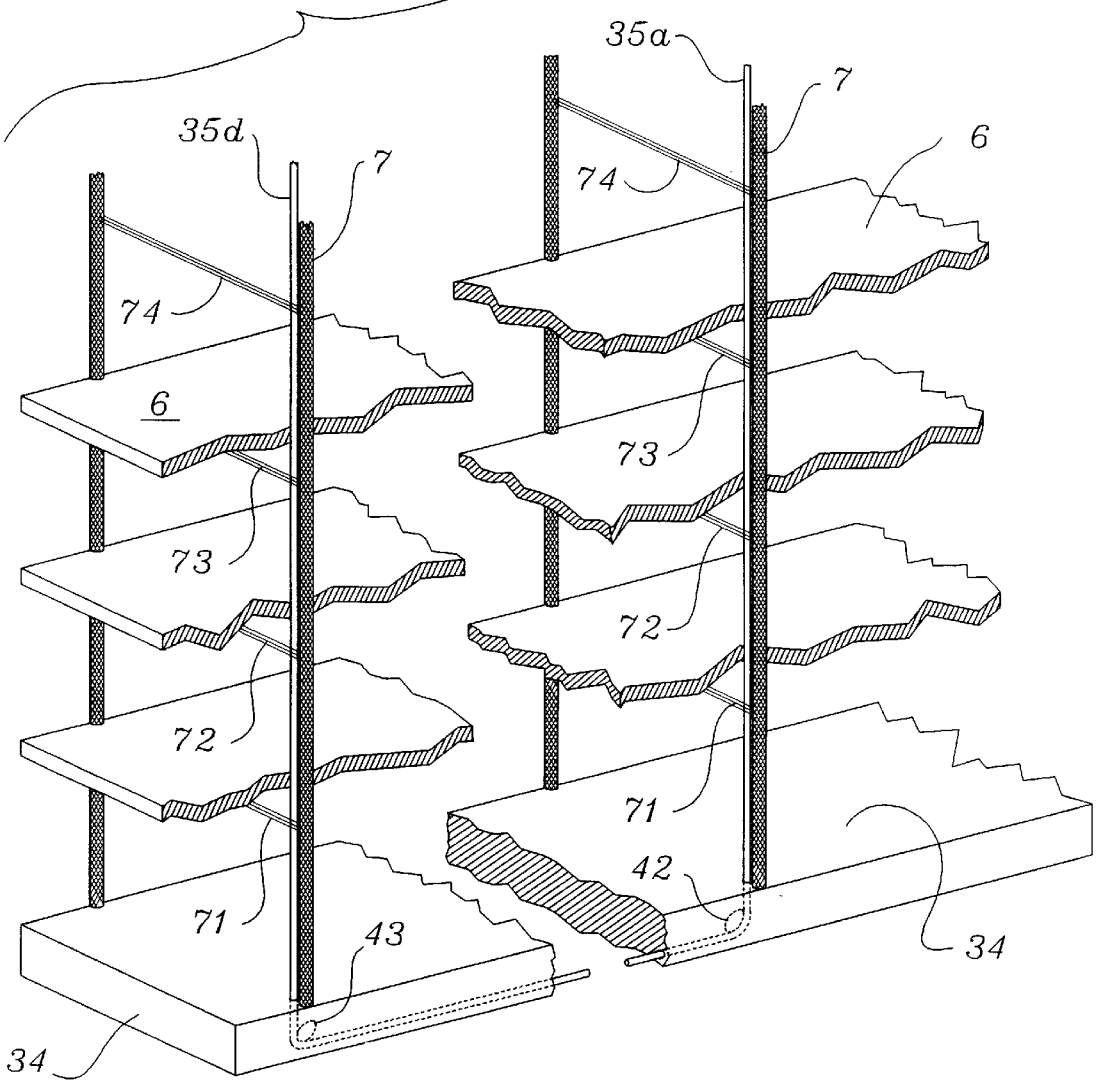
FIG. 8 is a perspective view of a portion of a venetian blind showing a preferred lacing of the lift cords and ladders.

As shown in FIG. 2, all of the lift cords 81, 82, 83 and 84 are routed in such a manner so that the lift cords are approximately equal in length from their point of attachment within the headrail to the cord lock 9. The outermost legs of lift cords 81 and 84 are descending. That is, when the cord lock is released the outermost legs of the portions of the lift cords 81, 84 will move from the headrail toward the bottomrail. Each of the lift cords passes around pulleys in the bottomrail. The first lift cord 81 is attached to the headrail at connector 20. The lift cord descends through route holes in the slats or adjacent the front edge or rear edge of the slats to the bottomrail 4. Then, the lift cord 81 passes around pulley 13 and then pulley 11. From pulley 11, the lift cord 81 is routed through or adjacent the slats up to the headrail 2 around roller 21 and out through cord lock 9. The second lift cord 82 is attached at anchor 22 in the headrail. That lift cord passes through or adjacent the slats around pulleys 14 and 12 within the bottomrail and back up to the headrail. Within the headrail lift cord 82 passes over pulley 23 and out cord lock 9. Pulley 23 is positioned within the headrail so that the length of lift cord 82 is the same as lift cord 81. The third lift cord 83 begins at anchor 24, passes over pulley 25, and goes through the slats to the bottomrail. There lift cord 83 goes around pulley 15 then around pulley 17 and returns to the headrail. Within the headrail the lift cord 83 runs around roller 26 to cord lock 9. Anchor 24 is positioned so that the length of lift cord 83 is the same as the length of lift cords 81 and 82. The fourth lift cord 84 is attached to anchor 27 at the opposite end of the headrail from cord lock 9. That lift cord passes around roller 28 to the bottomrail, around pulleys 16 and 18 within the bottomrail, back up to roller 29 within the headrail and out through cord lock 9. Anchor 27 is positioned so that the length of lift cord 84 is the same as the other three lift cords, 81, 82 and 83. Although the lift cords are shown to turn around pulleys or rollers 21, 25, 26, 28 and 29 in the headrail, it should be understood that a curved turning surface such as a rolled edge could be used in place of these pulleys or rollers. It should be apparent from FIG. 2 that the outermost portions of lift cords 81 and 84 are in a descending position adjacent either end of the blind. Since the descending cords tend to move faster than ascending cords, I prefer to lace the descending cords through or around the rungs more frequently than I lace the ascending cords. This lacing arrangement is shown in FIG. 8. Although I desire to have all of the lift cords the same length this may not be practical because of limited space in the headrail. Most likely, cord 81 which travels farthest from the cord lock will be longer. If so the benefits of this cording arrangement can still be achieved if the difference in length between cord 81 and the other cords 82, 83 and 84 does not exceed the distance between two adjacent vertical cord runs which in FIG. 2 is the distance between pulleys 11 and 13.

A second preferred cording arrangement is shown in the embodiment of a venetian blind 30 illustrated in FIGS. 3, 4, 5 and 6. That blind has a headrail 32 and bottomrail 34. A first lift cord 35 runs from anchor 41 in the headrail around pulleys 42 and 43 in the bottomrail to pulley 44 in the headrail and out through the cord lock 39. A second lift cord 36 is anchored in the headrail at anchor 40, runs from the headrail around pulley 45, through route holes in the slats (not shown), around pulley 46 in the bottomrail, back through the same route holes into the headrail and out through cord lock 39. The third lift cord 37 is anchored at the opposite end of the headrail from the cord lock by anchor 47. That lift cord runs from anchor 47 around pulley 48 in the headrail down through or adjacent the slats into the bottomrail. Within the bottomrail lift cord 37 passes around pulleys 49 and 50 and returns through or adjacent the slats to the headrail. There lift cord 37 passes around roller 51 and out through the cord lock 39. Anchors 40 and 47 and roller 51 are positioned so that the length of lift cord 37 will be the same as the length of lift cord 35. Thus, the outermost lift cords are of the same length and will have the same amount of stretch. Lift cord 36 is approximately the same length but smaller in diameter. For example, lift cord 36 could be 1.2 mm in diameter while lift cords 35 and 37 are 1.6 mm or 1.4 mm in diameter.

Figure 4:
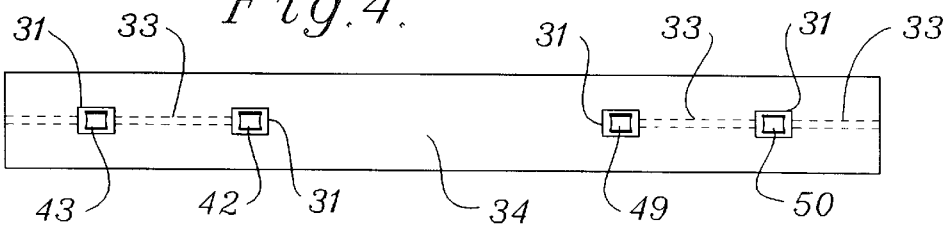
FIG. 4 is a bottom view of the bottomrail of the blind in FIG. 3.
Figure 5:
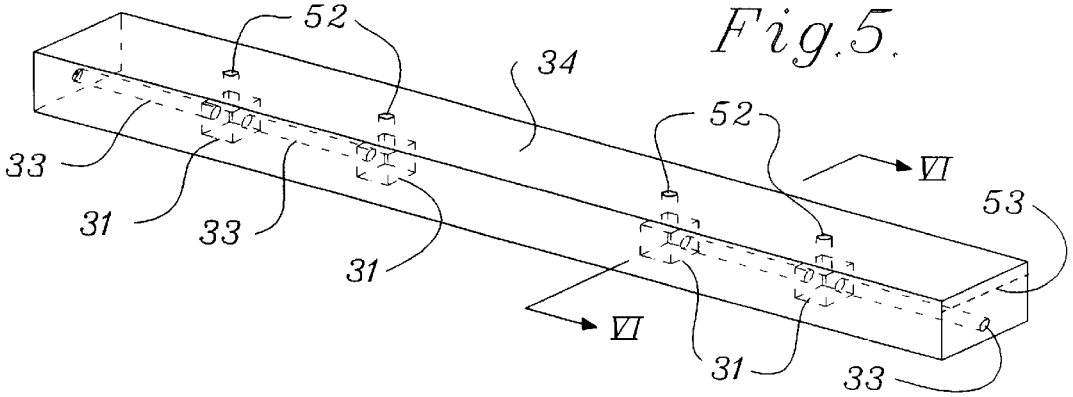
FIG. 5 is a perspective view of the bottomrail of the blind of FIG. 3.
Figure 6:
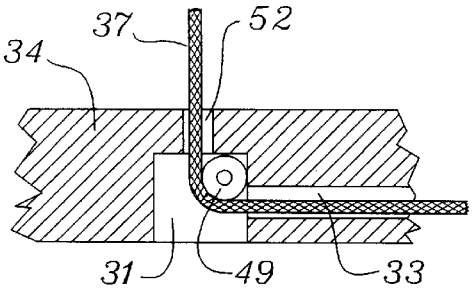
FIG. 6 is a sectional view of a portion of the bottomrail taken along the line VI—VI of FIG. 5.

The disclosed cording arrangements are suitable for both a hollow bottomrail and a solid bottomrail. As shown in FIGS. 4 and 5, bottomrail 34 is solid. Two channels 33 have been drilled transversely through the bottomrail from opposite ends. Cavities 31 are cut along the channels and open to the bottom as shown in FIGS. 4 and 6. Pulleys 42, 43, 49 and 50 are positioned within the cavities. A hole 52 is drilled from the top of the bottomrail to each cavity 31. Thus, the lift cord would pass through hole 51, around one pulley through the portion of the route hole 32 between the cavities, around the second pulley in the second cavity, and back up through route hole 52. I prefer to create channels 33 by drilling from the opposite ends of the bottomrail. Alternatively, one could drill a single hole from one end of the bottomrail to the cavity 31 furthest from that end so that the two channels 33 will be co-linear. Another option is to cut the channels and cavities into the top of the solid wood strip and then cover the strip with a slat to form the bottomrail. This option is indicated by dotted line 53.

Figure 7:
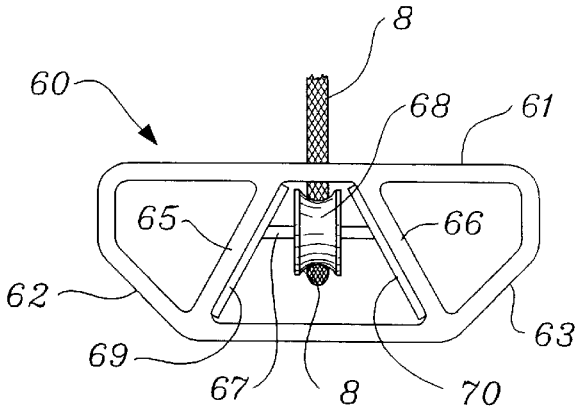
FIG. 7 is an end view of an alternate configuration for a bottomrail which can be used with the present cording arrangement.

A second preferred hollow bottomrail is shown in FIG. 7. That bottomrail 60 may be a plastic extrusion having a top 61, sides 62 and 63 and bottom 64. Two ribs 65 and 66 extend from the top to the intersection of the bottom 64 and side 62 or 63. The ribs are preferably reinforced by metal strips or plates 69, 70. The ribs 65 and 66 provide a mounting for an axle 67 which carries pulley 68 and act as a reinforcement member. The lift cord 8 would be routed around those pulleys. For ease of view the lift cord 8 is shown as being cut off underneath the pulley 68.

Figure 3:
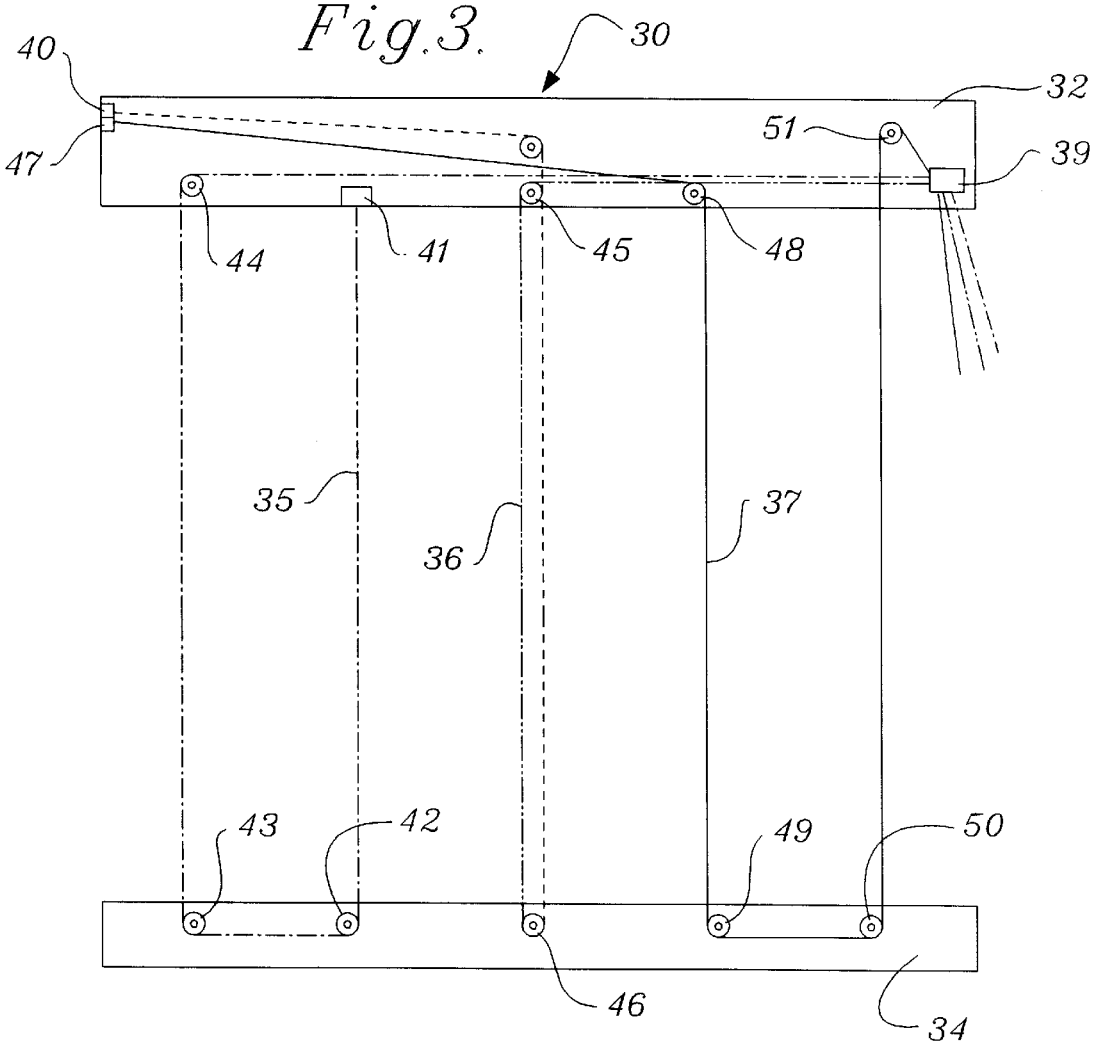
FIG. 3 is a diagram similar to FIG. 2 showing a cording arrangement for a smaller blind.

In FIG. 8 there is shown a lower segment of the blind of FIG. 3 around lift cord 35. The lift cord 35 is laced around the rungs of each ladder 7 and the rungs numbered in ascending order from the lowest rung 71 nearest the bottomrail 34. The descending portion 35d of the lift cord is laced at every other rung whereas the ascending portion is laced at every second rung. In FIG. 8 descending portion 35*d* is left of rung 71, right of rung 72, left of rung 73 and right of rung 74. The ascending portion 35*a* is woven less often. Ascending portion 35*a* is to the left of rungs 71 and 72 and to the right of rungs 73 and 74. In another embodiment not shown the ascending portion is laced at every eighth rung. This lacing creates more drag on the descending portion than on the ascending portion which tends to equalize the rate of movement of both portions eliminating the tendency of the descending portion to move faster.

Although I have shown lift cords adjacent each of the ladders in FIG. 1, it should be understood that this is not necessary. There may be some ladders provided without adjacent lift cords. The objective is provide a sufficient number of lift cords so that the bottomrail will retain its shape as it is raised and lowered and that the cords will pull smoothly through the headrail.

Figure 10:
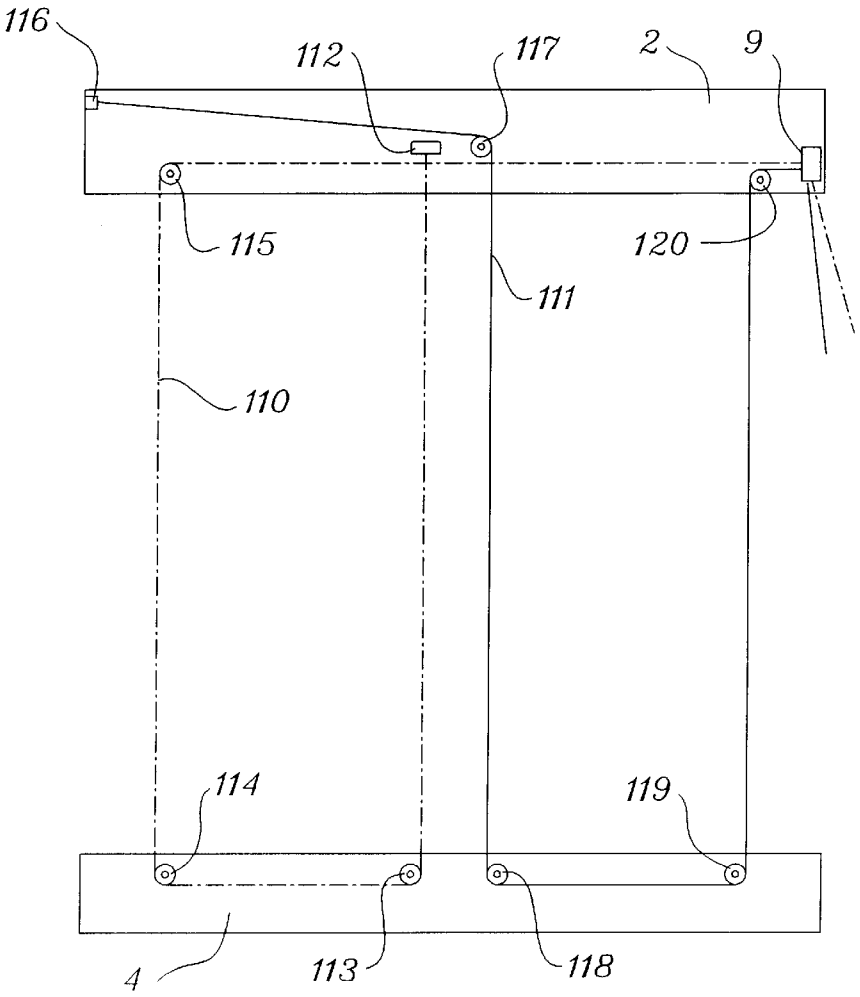
FIG. 10 is a diagram of a cording arrangement which utilizes three sets of route holes.
Figure 9:
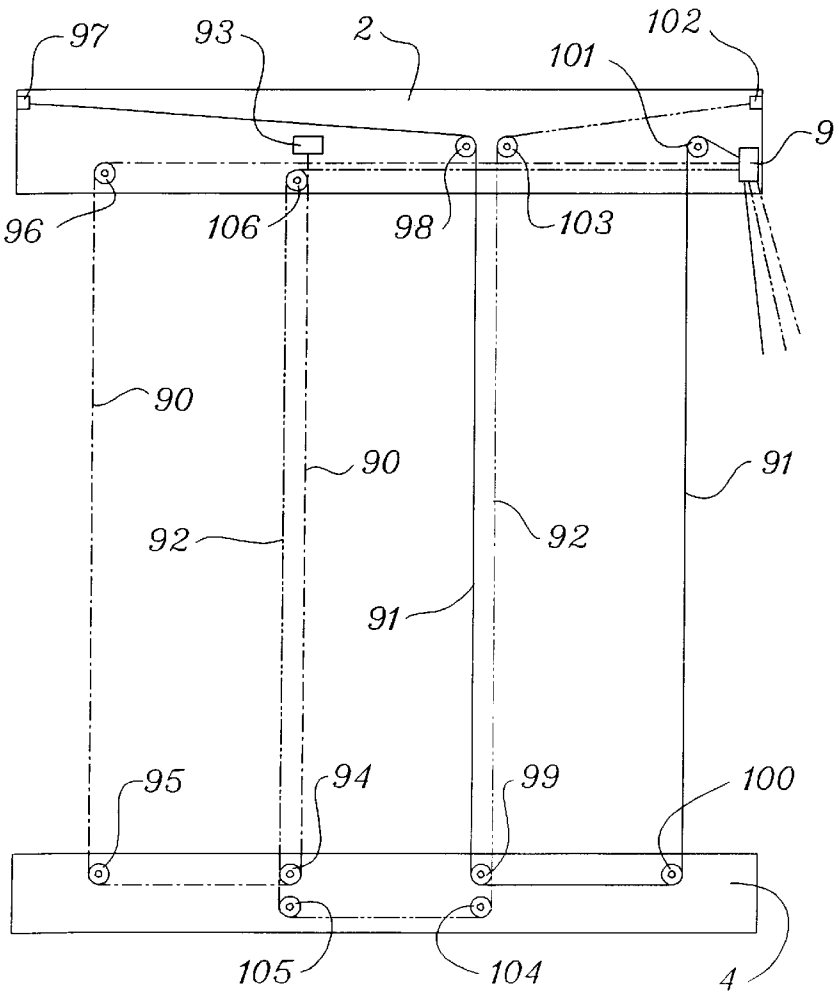
FIG. 9 is a diagram of a cording arrangement which utilizes four sets of route holes.

The convention in the venetian blind art is to provide not more than four cord routes for lift cords. In FIGS. 9 and 10 there are shown embodiments in which the lift cords run through four sets of route holes or three sets of route holes, respectively. Referring to the cording arrangement in FIG. 9 there are three lift cords 90, 91 and 92. These lift cords run through four cord routes which can be viewed form left to right as the first, second, third and fourth cord routes. Each cord route passes through one set of route holes wherein each set contains one route hole from each slat (not shown). Lift cord 90 begins at anchor 93, runs through the second cord route around pulleys 94 and 95 in the bottomrail 4 and back up to the headrail through the first cord route. In the headrail lift cord 90 goes around pulley 96 and out through cord lock 9. The second lift cord 91 begins at anchor 97 within the headrail. That lift cord travels around pulley or roller 98 in the headrail, through the third cord route around pulley 99 and 100 in bottomrail 4 and up through the fourth cord route to the headrail around pulley 100 and out through the cord lock 9. The third lift cord 92 begins at anchor 102 of the headrail and runs over pulley 103 in the headrail. Lift cord 92 goes through the third cord route holes into the bottomrail, around pulleys 104 and 105 and back up to the headrail through the second set of route holes. Within the headrail lift cord 92 goes around pulley or roller 106 and exits the headrail through cord lock 9. Although the portions of the lift cords shown in FIG. 9 as passing through the second and third sets of route holes are spaced apart, it should be understood that they will be much closer together passing through the same hole in each slat. Similarly, pulleys 99 and 105 may be on a common axis and pulleys 99 and 104 may be on another common axis.

The cording arrangement shown in FIG. 10 utilizes two lift cords 110 and 111 passing through three sets of cord routes. Lift cord 110 begins at anchor 112 within the headrail. It is routed through the second cord route into the bottomrail 4. There it passes around pulleys 113 and 114 and returns to the headrail 2 through the first cord route. Within the headrail lift cord 110 passes over a pulley with roller 115 and exits the headrail through cord lock 90. The second lift cord 111 begins at anchor 116 within the headrail and passes over pulley 117. Lift cord 111 goes through the second cord route to the bottomrail 4. Within the bottomrail lift cord 111 passes around pulleys 118 and 119 and returns to the headrail through the third cord route. Within the headrail lift cord 111 passes over pulley 110 and exits the headrail through cord lock 9.

In the embodiments shown in FIGS. 9 and 10, two lift cords pass through those sets of route holes which are not at either end of the blind. As a consequence, there are two lift cords lifting the load at pulleys 94 and 99 in the embodiment of FIG. 9 and at pulleys 113 and 118 in the blind of FIG. 10. Therefore, the load on each cord will be half of what a single cord would be required to lift at that point. By routing two cords through the same sets of route holes I can reduce the weight that each lift cord is required to lift. Therefore, I am able to balance the load on each of the cording arrangements by choosing some cord routes that have one lift cord and other cord routes that have two lift cords. In the cording arrangement of FIG. 10 each lift cord 110 and 111 is lifting the same weight. That weight would include the weight at pulleys 114 or 119 plus half the weight in the center of the blind where pulleys 113 and 118 are located. In the embodiment of FIG. 9, cord 92 runs with another lift cord in two sets of route holes through which cord 92 is threaded. If cord 92 is made of a smaller diameter than cords 90 and 91, cord 92 will have a greater stretch. This factor can also be considered in selecting the cording arrangement. By using cords of different diameter and providing two cords through certain sets of route holes, I am able to provide a cording arrangement which will lift the bottomrail 4 of a heavy blind without causing that bottomrail to bow or otherwise distort.

Although I have shown and described certain present preferred embodiments of my lift system for large venetian blinds it should be distinctly understood that the invention is not limited thereto, but may variously embodied within the scope of the following claims.

I claim:

1. A venetian type blind comprised of:

a. a headrail having a turning surface over which a lift cord may pass;

b. a bottomrail having a length and a width, the width being shorter than the length;

c. at least one pulley within the bottomrail, the pulley having an axis of rotation which is substantially perpendicular to the length of the bottomrail;

d. a plurality of ladders extending from the headrail to the bottomrail;

e. a plurality of slats carried on the ladders; and f. at least one lift cord having one cord fixedly attached to a point within the headrail which point is spaced apart from the turning surface, the one lift cord extending from the point, over the turning surface, to the bottomrail, over the at least one pulley and back to the headrail.

2. The venetian type blind of claim 1 wherein there are a plurality of lift cords and a distance between adjacent lift cords, each lift cord having a length such that a difference between lengths of any two lift cords is not greater than the distance between adjacent lift cords.

3. The venetian type blind of claim 1 wherein the bottomrail is solid and contains a first cavity and a second cavity connected by a channel and the at least one pulley is a first pulley within the first cavity and a second pulley within the second cavity.

4. A venetian type blind comprised of:

a. a headrail;

b. a bottomrail having a length and a width, the width being shorter than the length;

c. at least one pulley within the bottomrail, the pulley having an axis of rotation which is substantially perpendicular to the length of the bottomrail;

d. a plurality of ladders extending from the headrail to the bottomrail;

e. a plurality of slats carried on the ladders; and f. at least one lift cord extending from the headrail, to the bottomrail over the at least one pulley and back to the headrail, wherein the slats each have only one route hole and the at least one lift cord passes through the route hole in each slat.

5. A venetian type blind comprised of:

a. a headrail;

b. a bottomrail having a length and a width, the width being shorter than the length;

c. at least one pulley within the bottomrail, the pulley having an axis of rotation which is substantially perpendicular to the length of the bottomrail;

d. a plurality of ladders extending from the headrail to the bottomrail;

e. a plurality of slats carried on the ladders; and f. a first lift cord and a second lift cord, the first lift cord having a diameter smaller than a diameter of the second lift cord, the first lift cord and the second lift cord extending from the headrail, to the bottomrail over the at least one pulley and back to the headrail.

6. The venetian type blind of claim 5 wherein each lift cord has a length measured between a point where the lift cord is attached to the headrail and a point at which the lift cord passes through a cord lock and the length of the first lift cord is less than the length of the second lift cord.

7. The venetian type blind of claim 1 wherein the lift cords in the plurality of lift cords are each routed in a manner so that each lift cord lifts a same amount of weight.

8. The venetian type blind of claim 1 wherein those portions of the plurality of lift cords nearest each end of the blind are descending.

9. A venetian type blind comprised of:

a. a headrail;

b. a bottomrail having a length and a width, the width being shorter than the length;

c. at least one pulley within the bottomrail the pulley having an axis of rotation which is substantially perpendicular to the length of the bottomrail;

d. a plurality of ladders extending from the headrail to the bottomrail;

e. a plurality of slats carried on the ladders; and a plurality of lift cords extending from the headrail, to the bottomrail over the at least one pulley and back to the headrail, wherein each lift cord of the plurality of lift cords has an ascending portion and a descending portion both portions being laced through rungs of a ladder such that the descending portion is laced more often than the ascending portion.

10. A venetian type blind of claim 1 wherein the plurality of ladders is comprised of:

a. first, second, third and fourth ladders extending from the headrail, respectively attached to the bottomrail at first, second, third and fourth ladder attachment locations and arranged consecutively from one end of the blind to an opposite end of the blind;

b. the at least one pulley is comprised of:

i. a first pulley attached to the bottomrail at the first ladder attachment location;

ii. a second pulley attached to the bottomrail at the second ladder attachment location;

iii. a third pulley attached to the bottomrail at the third ladder attachment location; and iv. a fourth pulley attached to the bottomrail at the fourth ladder attachment location; and c. the at least one lift cord is comprised of:

i. a first lift cord having one end attached to the headrail and being routed from the headrail along the second ladder over the second pulley, through a portion of the bottomrail over the first pulley, along the first ladder, and through the headrail to a position outside the headrail; and ii. a second lift cord having one end attached to the headrail and being routed from the headrail along the third ladder, over the third pulley, through a second portion of the bottomrail over the fourth pulley, along the fourth ladder, and through the headrail to a position outside the headrail.

11. The venetian type blind of claim 10 wherein the first lift cord and the second lift cord have a same length.

12. The venetian type blind of claim 10 also comprising a first roller within the headrail over which the first lift cord passes and a second roller within the headrail over which the second lift cord passes.

13. The venetian type blind of claim 10 wherein the bottomrail is solid and has a cavity for each pulley in which cavity one of the pulleys is contained, a first channel through which the first lift cord passes and a second channel through which the second lift cord passes.

14. The venetian type blind of claim 13 also comprising a slat covering the cavities in the bottomrail.

15. The venetian type blind of claim 13 wherein the first channel and the second channel are co-linear.

16. A venetian type blind comprised of:

a. a headrail;

b. a bottomrail having a length and a width, the width being shorter than the length;

c. first, second, third and fourth ladders extending from the headrail, respectively attached to the bottomrail at first, second, third and fourth ladder attachment locations and arranged consecutively from one end of the blind to an opposite end of the blind;

d. a plurality of slats carried on the ladders;

e. at least four pulleys within the bottomrail, the pulleys each having an axis of rotation which is substantially perpendicular to the length of the bottomrail such that there is:

i. a first pulley attached to the bottomrail at the first ladder attachment location;

ii. a second pulley attached to the bottomrail at the second ladder attachment location;

iii. a third pulley attached to the bottomrail at the third ladder attachment location; and iv. a fourth pulley attached to the bottomrail at the fourth ladder attachment location; and f. a first lift cord having one end attached to the headrail and being routed from the headrail along the second ladder over the second pulley, through a portion of the bottomrail over the first pulley, along the first ladder, and through the headrail to a position outside the headrail; and g. a second lift cord having one end attached to the headrail and being routed from the headrail along the third ladder, over the third pulley, through a second portion of the bottomrail over the fourth pulley, along the fourth ladder, and through the headrail to a position outside the headrail;

wherein the ladders have rungs and the first lift cord is woven through more rungs of the first ladder than rungs of the second ladder and the second lift cord is woven through more rungs of the fifth ladder than rungs of the fourth ladder.

17. The venetian type blind of claim 1 wherein the slats are plastic.

18. The venetian type blind of claim 1 wherein the bottomrail and slats have a combined weight of at least 20 pounds.

19. The venetian type blind of claim 1 wherein the bottomrail is hollow.

20. The venetian type blind of claim 19 also comprising a reinforcement member within the bottomrail.

21. A venetian type blind comprised of:

a. a headrail;

b. a bottomrail;

c. first, second and third ladders extending from the headrail, respectively attached to the bottomrail at first, second and third ladder attachment locations and arranged consecutively from one end of the blind to an opposite end of the blind;

d. a plurality of slats carried by the ladders;

e. a first pulley attached to the bottomrail at the first ladder attachment location;

f. a second pulley attached to the bottomrail at the second ladder attachment location;

g. a third pulley attached to the bottomrail at the third ladder attachment location;

h. a first lift cord having one end attached to the headrail and being routed from the headrail along the second ladder, over the second pulley through a portion of the bottomrail over the first pulley, along the first ladder and through the headrail and to a position outside the headrail; and i. a second lift cord having one end attached to the headrail and being routed from the headrail along the second ladder through a second portion of the bottomrail over the third pulley, along the third ladder, and through the headrail and to a position outside the headrail.

22. The venetian type blind of claim 21 wherein the first lift cord and the second lift cord have a same length.

23. The venetian type blind of claim 21 wherein the slats are plastic.

24. The venetian type blind of claim 21 wherein the bottomrail and slats have a combined weight of at least 20 pounds.

25. The venetian type blind of claim 21 also comprising a first roller within the headrail over which the first lift cord passes and a second roller within the headrail over which the second lift cord passes.

26. The venetian type blind of claim 21 also comprising:

a. a fourth ladder extending from the headrail and attached to the bottomrail at a fourth ladder attachment location;

b. a fourth pulley attached to the bottomrail at the fourth ladder attachment location; and c. a fourth lift cord having one end attached to the headrail and being routed from the headrail along the third ladder, through a third portion of the bottomrail over the fourth pulley along the fourth ladder and through the headrail to a position outside the headrail.

27. The venetian type blind of claim 21 wherein the bottomrail is solid and has a cavity for each pulley in which cavity one of the pulleys is contained, a first channel through which the first lift cord passes and a second channel through which the second lift cord passes.

28. The venetian type blind of claim 21 also comprising a slat covering the cavities in the bottomrail.

29. The venetian type blind of claim 21 wherein the ladders have rungs and the lift cords are woven through selected rungs.

30. The venetian type blind of claim 29 wherein the first lift cord is woven through more rungs of the first ladder than rungs of the second ladder and the second lift cord is woven through more rungs of the fourth ladder than rungs adjacent the third ladder.

31. The venetian type blind of claim 21 wherein the bottomrail is hollow.

32. The venetian type blind of claim 31 also comprising a reinforcement member within the bottomrail.

33. A venetian type blind comprised of:

a. a headrail having a turning surface over which a lift cord may pass;

b. a bottomrail;

c. at least one pulley within the bottomrail;

d. a plurality of ladders extending from the headrail to the bottomrail;

e. a plurality of slats carried on the ladders; and e. a plurality of lift cords and a distance between adjacent lift cords each lift cord having one end fixedly attached to a point within the headrail which point is spaced apart from the turning surface, the at least one lift cord extending from the point, over the turning surface, to the bottomrail, over the at least one pulley and back to the headrail each lift cord having a length such that a difference between lengths of any two lift cords is not greater than the distance between adjacent lift cords.

34. The venetian type blind of claim 33 wherein the bottomrail is solid and contains a first cavity and a second cavity connected by a channel and the at least one pulley is a first pulley within the first cavity and a second pulley within the second cavity.

35. The venetian type blind of claim 33 wherein the slats each have a route hole and at least one lift cord passes through the route hole in each slat.

36. The venetian type blind of claim 33 wherein at least one lift cord comprises a first lift cord and a second lift cord, the first lift cord having a diameter smaller than a diameter of the second lift cord.

37. The venetian type blind of claim 36 wherein each lift cord has a length measured between a point where the lift cord is attached to the headrail and a point at which the lift cord passes through a cord lock and the length of the first lift cord is less than the length of the second lift cord.

38. The venetian type blind of claim 33 wherein the lift cords in the plurality of lift cords are each routed in a manner so that each lift cord lifts a same amount of weight.

39. The venetian type blind of claim 33 wherein those portions of the plurality of lift cords nearest each end of the blind are descending.

40. The venetian type blind of claim 33 wherein each lift cord of the plurality of lift cords has an ascending portion and a descending portion both portions being laced through rungs of a ladder such that the descending portion is laced more often than the ascending portion.

41. The venetian type blind of claim 33 wherein the ladders have rungs and the lift cords are woven through selected rungs.

42. The venetian type blind of claim 41 wherein a first lift cord is woven through more rungs of the first ladder than rungs of the second ladder and a second lift cord is woven through more rungs of the fourth ladder than rungs adjacent the third ladder.

43. The venetian type blind of claim 33 wherein the bottomrail is hollow.

44. The venetian type blind of claim 43 also comprising a reinforcement member within the bottomrail.

* * * * *